United States Patent [19]

Adam-Nicolau

[11] Patent Number: 4,791,824

[45] Date of Patent: Dec. 20, 1988

[54] HYDRAULIC ASSISTED MACHINE

[75] Inventor: Neculai Adam-Nicolau, Athens, Ga.

[73] Assignee: Delphin Corporation, Washington, D.C.

[21] Appl. No.: 7,573

[22] Filed: Jan. 28, 1987

[51] Int. Cl.[4] ..... F16H 25/08; F15B 15/10

[52] U.S. Cl. ..... 74/55; 60/593; 74/110; 74/569

[58] Field of Search ..... 74/55, 569, 110; 60/533, 537, 593

[56] References Cited

U.S. PATENT DOCUMENTS

| | | | |
|---|---|---|---|
| 411,322 | 9/1889 | Carnes | 74/55 |
| 1,805,802 | 5/1931 | Browne | 60/533 X |
| 2,852,086 | 9/1958 | Cordry | 74/569 X |
| 3,066,476 | 12/1962 | Conrad | 123/46 R X |
| 3,269,321 | 8/1966 | Eickmann | 123/46 X |
| 3,344,685 | 10/1967 | Crouzet | 74/569 |
| 3,524,474 | 8/1970 | McCormick | 92/38 X |
| 3,905,339 | 9/1975 | Wallis | 123/46 R |
| 4,004,422 | 1/1977 | Levan | 60/533 |
| 4,085,710 | 4/1978 | Savarimuthu | 123/46 SC X |

FOREIGN PATENT DOCUMENTS

| | | | |
|---|---|---|---|
| 122338 | 9/1946 | Australia | 74/55 |

*Primary Examiner*—Allan D. Herrmann

*Attorney, Agent, or Firm*—Daniel R. Gropper

[57] ABSTRACT

This invention relates to a mechanism and a process by which hydraulic pressure principles may be applied to any reciprocating or rotational means, for instance a piston or a motor, to make the energy output thereof more efficient per unit of energy input into these machines. The unitary hydraulic unit comprises a first larger reservoir cylinder and a second smaller reservoir cylinder which is fluidly connected to the first larger cylinder. Energy is input onto the force receiving surface of the first larger reservoir cylinder and force is hydraulically transferred from the first larger hydraulic cylinder to the force transferring surface of the second smaller hydraulic reservoir. In a preferred embodiment, this two-reservoir system can be applied to any machine with a rotational output by means of a disclosed power conversion means. An efficient power takeoff means for converting reciprocal energy into rotational energy for use in connection wiht the unitary hydraulic unit is also disclosed.

29 Claims, 5 Drawing Sheets

HYDRAULIC ASSISTED MACHINE

BACKGROUND OF INVENTION

1. Field of Invention

This invention relates to a unitary hydraulic unit which can be placed in any reciprocating machine to increase the output efficiency thereof through hydraulic principles. The invention also teaches efficient power input and output means which may be used in connection with the unitary hydraulic unit to provide an extremely efficient machine.

2. Description of Related Art

Reciprocating engines have been used for many years. Several inventions have been disclosed which employ hydraulic fluid as a force transfer medium. These include U.S. Pat. Nos. 3,905,339 to Wallis, 3,269,321 to Eickmann and 3,066,472 to Conrad. All these references disclose a pair of pistons having different diameters, whereby the smaller piston diameter impels hydraulic fluid to move through pipelines.

Differing from these inventions, the instant invention employs force directed to a larger piston whereby the output is through a smaller piston. While the same general concept is taught in U.S. Pat. No. 4,085,710 to Savarimuthu, this particular patent is directed to the use of hydraulic fluid as a force transfer medium in an internal combustion engine. The instant invention relates to a unitary hydraulic force transfer medium which can be placed in line with the output of any reciprocating power source and provide hydraulically assisted increased linear output per unit of force input. Additional power input and output devices are also disclosed, which, together with the unitary hydraulic unit, operate to make an extremely efficient machine.

BRIEF SUMMARY OF INVENTION

It is therefore an objective of this invention to be able to take advantage of basic hydraulic output principles to gain a more efficient output from any reciprocating or rotational power source.

A further objective of this invention is to provide a unitary two cylinder, simple, safe and effective hydraulic system which can be placed in line with the output of any reciprocating power source to increase the efficiency thereof.

Another objective of this invention is to provide a unitary hydraulic system which is extremely durable having parts which can be economically manufactured and readily assembled and thereby widely available.

Another objective of this invention is to provide a unitary hydraulic output system to be applied to the reciprocating output of massive energy power turbines to increase the efficiency thereof and to thereby decrease the fuel requirements necessary to meet the energy needs of the country and thereby decrease dependence on foreign sources of energy.

Another objective of this invention is to provide a unitary hydraulic system which can be applied to factory engines and other types of engines to increase the efficiency thereof and to otherwise decrease energy consumption thereof.

Another objective of this invention is to place the unitary hydraulic system mechanism in line with a piston which is powered by a efficient power rotational axial power means having diametrically opposed arms emanating therefrom to efficiently convert rotational energy into reciprocating energy to be used in connection with the unitary hydraulic unit.

A further objective of this invention is to provide support for the reciprocating power of upper shaft by means of roller bearings having an internal track to support the ball bearings.

A further object of this invention is to provide an efficient rotational power takeoff means to be used in connection with the unitary hydraulic unit.

DETAILED DESCRIPTION OF THE PREFERRED EMBODIMENT

Figure 1:
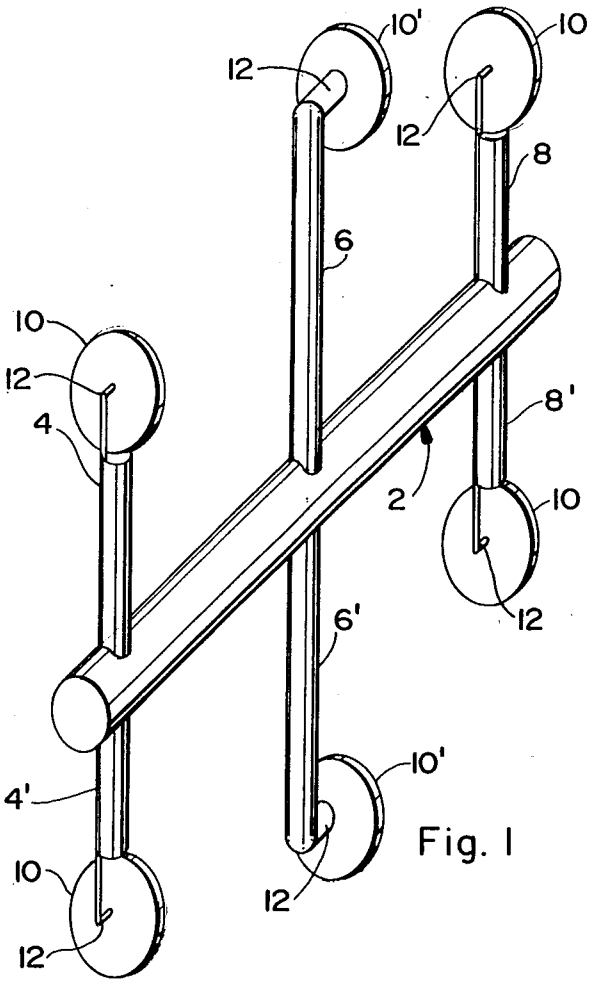
FIG. 1 is a perspective view of the power input means having diametrically opposed pairs of arms with wheels rotationally connected at the distal ends thereof.

In the drawings, like numerals will designate similar parts in each drawing.

Figure 5:
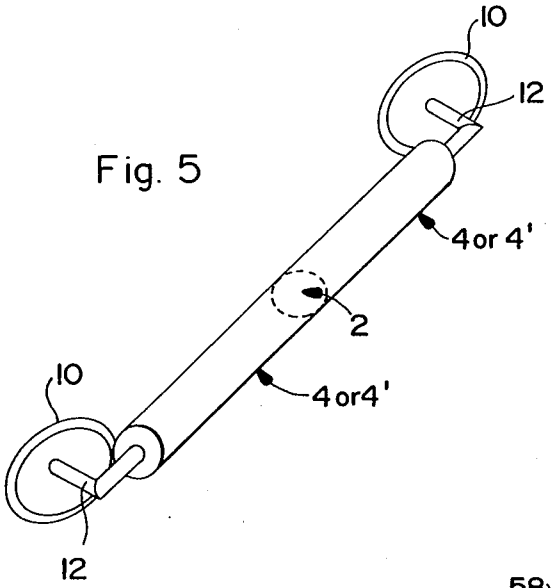
FIG. 5 is a perspective view of a power input arm showing two rotationally attached wheels.
Figure 6B:
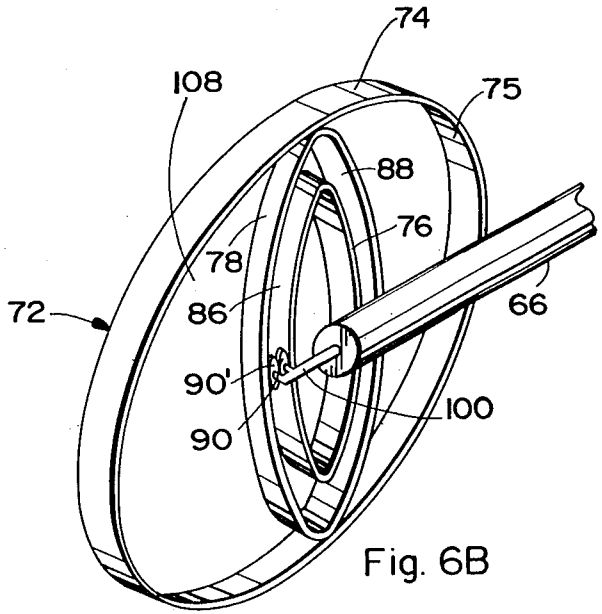
FIGS. 6A and 6B are detailed perspective views of the power takeoff assembly at the zero and ninety degree points in the cycle.
Figure 6A:
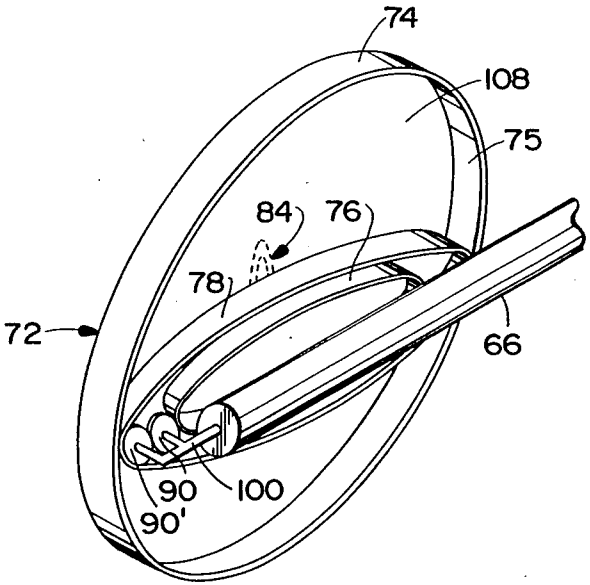

With reference to the drawings in FIG. 1, rotational power may be input into the unitary hydraulically assisted device by means of a power conversion means through rotational force being applied to shaft 2 which in turn supplies rotational power to arms 4, 4', 6, 6', 8, and 8'. Arms 4, 4', 6, 6, 8, and 8' are attached to shaft 2 in a manner such that each of the numbered pairs, for example 4 and 4' are substantially axially parallel with respect to one another, and whereby the wheel pairs extend in diametrically opposed relationship to one another with respect to the axis of shaft 2. Additionally, the axes of each of the arms is substantially perpendicular to the axis of shaft 2. An exterior wheel 10 is disposed at the distal tip of each arm 4, 4', 6, 6', 8, and 8'. Each wheel 10 is connected to its respective arm by means of axle 12 which depends from the distal end of each of each of the respective arms 4, 4', 6, 6', 8, and 8'. In the preferred embodiment, arms 6 and 6', which are located centrally along shaft 2 between arms 4, 4', 8 and 8', are longer than arms 4, 4', 6 and 6'. FIG. 5 shows the detail of a typical arm 4 or 4', having a pair of axles 12 and wheels 10 and 10'. It will be understood that many different arm configurations may be used without departing from the scope of this invention.

Figure 2:
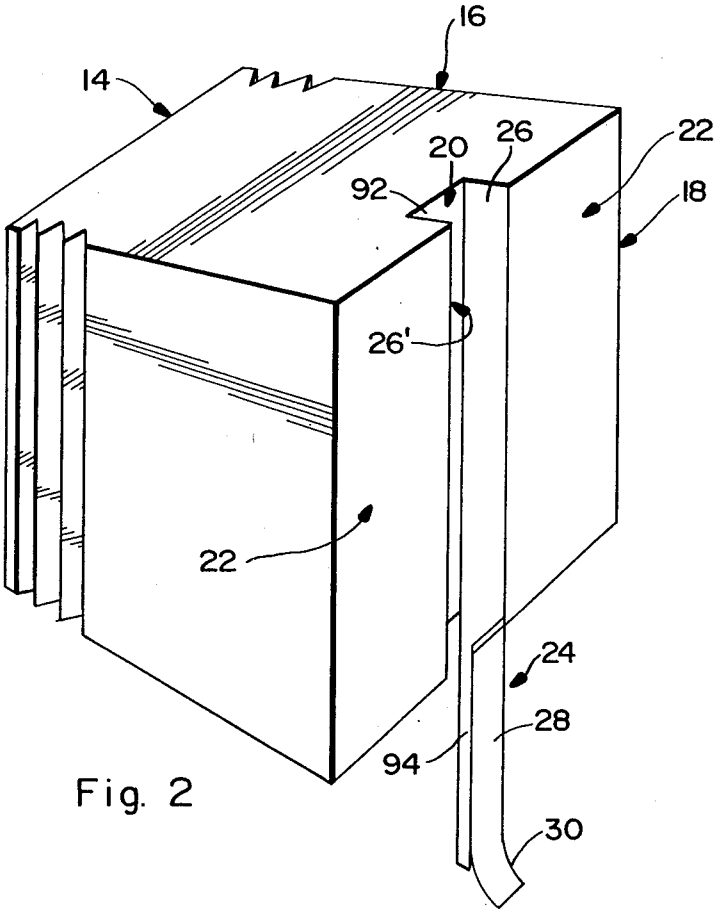
FIG. 2 is a perspective view of the piston having a slot formed therein to receive the central wheels of the power input arms.

By means of general reference, piston 16 has a leading end 14 and a trailing end 18. In operation, rotational power is applied to shaft 2 which causes the arms 4, 4', 6, 6', 8, and 8' to rotate. This in turn causes wheels 10, 10' to contact the trailing surface 22 of trailing end 18 of piston 16. Referring to FIG. 2, U-shaped slot 20 is formed in the trailing end 18 of piston 16. Slot 20 has an interior wall 92 and the pair of opposed side walls 26 and 26'. Depending from the trailing end 18 of piston 16 is an "L" shaped contact surface 24. The "L" shaped contact surface 24 has a front contact plate 28 which is connected to piston 16 by means of sidewall extension 94. Side wall extension 94 is formed in such a manner as to allow the central wheels 10 and 10' and rotational axle 12 of center arms 6 and 6' to pass between front contact plate 28 and sidewall 26' of piston 16. In an alternate embodiment, "L" shaped contact surface 24 can be formed so as to allow wheel 10 to pass between front contact plate 28 and sidewall 26. In the preferred embodiment, an outwardly curved base tail 30 may be formed at the lower end of the "L" shaped contact surface 24 in order to provide for a smoother disengagement of wheel 10' and axle 12 from piston 16.

Figure 3A:
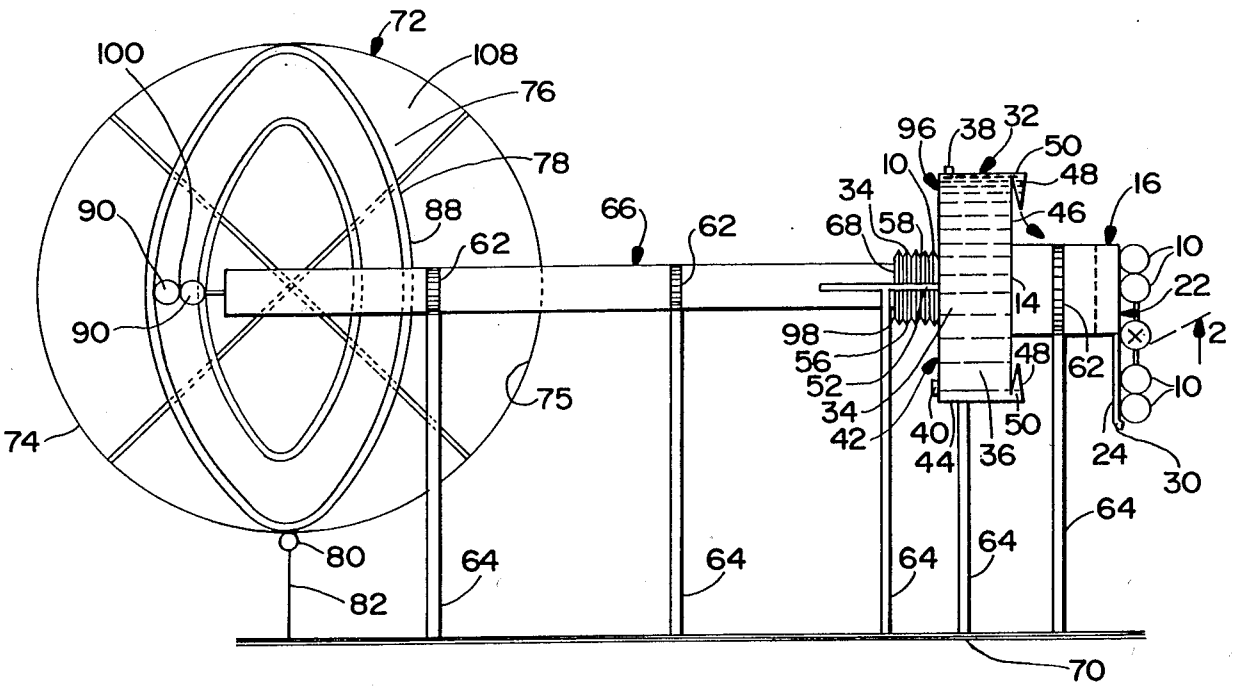
FIGS. 3A and 3B are cross-sectional views, partially cut away, showing the interrelationship of the rotational axial power input device and, piston of FIG. 2, the unitary hydraulic unit and the power takeoff assembly.
Figure 3B:
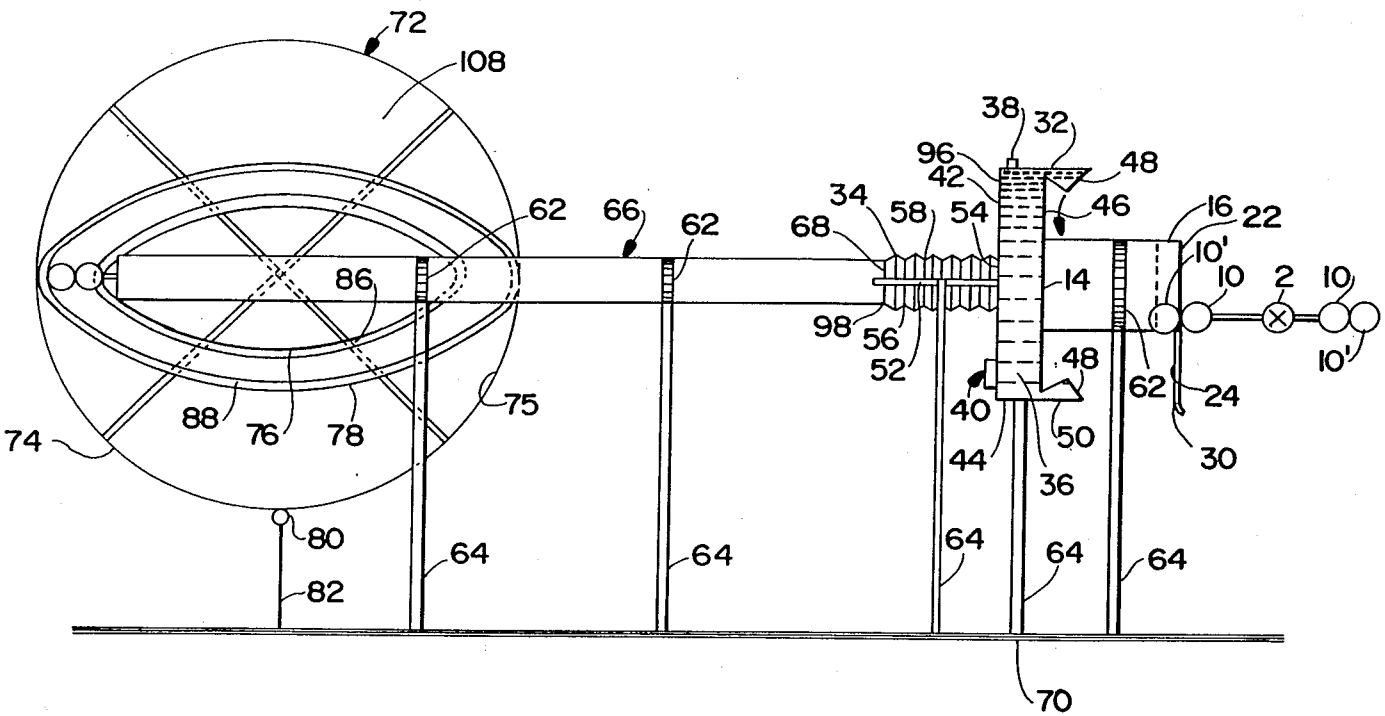

FIG. 3A shows wheels 10 and 10' in a substantially perpendicular position to piston 16 wherein leading edge 14 of piston 16 is contacting, but not compressing, force receiving surface 46 of unitary hydraulic unit 96. Accordingly, power reception assembly 72 is in a first position. FIG. 3B shows wheels 10 and 10' contactingly engaged with contact trailing edge 22 of piston 16 wherein force receiving surface 46 of unitary hydraulic unit 96 is compressed and power reception assembly 72 is in the second position, which is rotated 90 degrees from said first position.

In operation, as rotational force is applied to shaft 2, both outer wheels 10 contact trailing surface 22 of piston 16 and wheel 10' contacts interior wall 92 of slot 20. As shaft 2 continues to rotate through its first 90 degrees of rotation, piston 16 is reciprocally pushed in a first direction. As shaft 2 continues to rotate through its second 90 degrees of rotation, wheel 10' contacts the inner surface of front contact plate 28 thereby causing piston 16 to reciprocate in a second direction, opposite said first direction, and generally towards shaft 2 in a reciprocating manner. As shaft 2 continues through its rotation, wheel 10' rides along the inner surface of curved base tail plate 30 and finally disengages completely from piston 16. As shaft 2 continues through its second 180 degrees of rotation the cycle is repeated with the second set of wheels. Accordingly, piston 16, will reciprocate through two complete cycles for each complete rotation of shaft 2.

Figure 4:
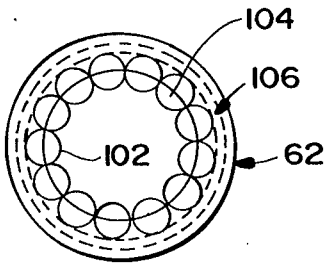
FIG. 4 is a front plan view of a support roller bearing having an internal roller bearing track.

With reference to FIGS. 3A and 3B, piston 16, in certain embodiments, may be supported by vertical support 64 which is in turn connected to internal ring bearing support 62. FIG. 4 shows a detail of internal ring bearing support 62, having a plurality of ball bearings 104 which travel in an internal track 106 formed in casing 102.

As reciprocating force is applied to piston 16, leading edge 14 of piston 16 is similarly caused to reciprocate. In the preferred embodiment leading edge 14 is in contact with force receiving surface 46 of unitary hydraulic unit 96. Unitary hydraulic unit 96 is comprised of a first larger diameter reservoir 32 and a second smaller diameter reservoir 34. Together, first hydraulic reservoir 32 and second hydraulic reservoir 34 define an enclosed cavity containing hydraulic fluid 36. Hydraulic fluid is placed in the cavity by means of fluid fill port 38. The hydraulic fluid is kept cool by means of a hydraulic fluid cooling system 40 which is well known in the art. First large reservoir 32 has a base plate 42 and a circumferential side wall 44 connected to base plate 42. Force receiving surface 46 is configured to be slidingly disposed within the cavity defined by sidewall 44 of first hydraulic reservoir 32. Force receiving surface 46 and sidewall 44 of first larger reservoir 32 are kept in constant, liquid-tight contact by means of inwardly depending lip and seal 48. Lip and seal 48 may be any commonly known type of elastomeric seal and is configured in such a manner as to prevent the escape of hydraulic fluid from between force receiving surface 46 and sidewall 44.

Figure 7B:
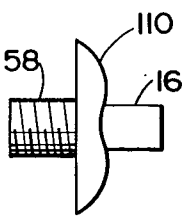
FIGS. 7A and 7B are perspective views of alternate embodiments of the reservoir and force receiving surface thereof.
Figure 7A:
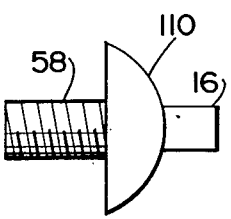

In an alternate embodiment, as shown in FIGS. 7A and 7B, sidewall 44, lip and seal 48 and force receiving surface 46 may all be formed of a unitary flexible resilient material, generally designated 110, for ease and economy of manufacture.

In operation, force receiving surface 46 is caused to linearly reciprocate within first reservoir 32 along the top portion of sidewall 44 which is generally designated 50.

Second small reservoir 34 is held in spacial relationship and orientation with respect to first reservoir 32 by means of pairs of side supports 52 which allows the second reservoir to slidably move therebetween. Different embodiments may use pluralities of pairs of side supports 52. Second small reservoir 34 has a bellows-like construction generally designated 56. The bellows-like structure 56 consists of a plurality of small diameter rings 58 interspaced with larger diameter rings 60. The bellows-like structure of the second small reservoir 34 may be made of any elastomeric and structurally resilient nonporous material.

A power takeoff shaft 66 is connected to force transferring surface 98 of small reservoir 34. Force transferring surface 98 is substantially coaxially aligned with force receiving surface 68 of power takeoff shaft 66. Power takeoff shaft 66 may be supported by means of internal ring roller bearings 62 and supports 64. It will be understood that in keeping with the general scope of this invention there may be a plurality of slidable support means for power takeoff shaft 66 which will vary in accordance with the application to which the invention is put. In the embodiment shown, the entire apparatus is supported by means of vertical supports 64, being affixed to support base 70.

It will be understood that the power takeoff from force transferring surface 98 may be directly connected to any of a variety of reciprocating power reception means such as, but not limited to, crank shafts, gears, pulleys and other mechanical means.

One such embodiment of a power reception assembly is shown in FIGS. 3A, 3B, 6A and 6B, and is generally designated 72. The power reception assembly consists of a wheel or gear 74, which is connected to and supported by plate 108. Two concentric ellipses, 76 and 78, are disposed on the face of plate 108. Ellipse 76 is the internal ellipse and ellipse 78 is the external ellipse.

An auxiliary power source, generally designated 80, may, in certain circumstances, be used in rotational connection with wheel or gear 74 in order to insure a rotation of power reception assembly 72 in the desired direction with respect to rotation about axle 84, which rotatably supports power reception assembly 72. Auxiliary power source 80 may advantageously be in the form of any rotational power source including an electric motor or power takeoff from a power shaft. In the embodiment shown, auxiliary power source 80 is vertically supported by means of auxiliary power source support 82 which is in turn affixed to support base 70.

The linear length of internal raceway 88 of external ellipse 78, in the preferred embodiment, is equal to the linear length of internal raceway 75 of wheel 74. The external raceway 86 of internal ellipse 76 and the internal raceway 88 of external ellipse 78 act as contact surfaces for the ball bearing assemblies, designated 90 and 90', respectively, which are in turn attached to power takeoff shaft 66 by means of axle or axles 100.

In operation, as power takeoff shaft 66 advances toward power reception assembly 72, ball bearing 90' moves along one-fourth of the linear length of internal raceway 88 of external ellipse 78, thereby causing wheel 74 to rotate ninety degrees. Simultaneously, bearing 90 is caused to move in the same direction along one-fourth of the length of external raceway 86 of internal ellipse 76. As power takeoff shaft 66 moves in a direction away from power reception assembly 72, bearing 90 in turn moves along a second one-fourth length section of external raceway 86 of internal ellipse 76, thereby causing wheel 74 to rotate another ninety degrees in the same direction. During this same time period, bearing 90' is caused to move along another one-fourth of the linear length of internal raceway 88 of external ellipse 78. In this manner, two complete reciprocating linear cycles (forwards and backwards) of power takeoff shaft 66 are necessary to cause wheel 74 to complete a full rotation of three hundred and sixty five degrees. The periphery of wheel 74 is caused to rotate at a uniform linear speed as force is applied in a constant and equal manner onto the raceways 86 and 88 of internal and external ellipses 76 and 78, respectively. Rotational power may be taken directly off of wheel or gear 74 by direct mechanical connection therewith.

Numerous other objects, features and advantages of this invention should become obvious to persons of ordinary skill in the art through the drawings and disclosure herein.

What I claim is:

1. A hydraulically assisted power transfer device comprising:

a first reservoir cylinder having a rigid base and an axial aperture formed in said rigid base, a resilient force receiving surface on the opposite end thereof from said base, and a sidewall connecting said base and said force receiving surface;

a second reservoir, having a base with an axial aperture, a force transferring surface disposed at the opposite end thereof from said base, and a sidewall connecting said base and said force transferring surface wherein said first and second reservoirs together define a closed fluid container, wherein said axial aperture of said base of said first reservoir is in fluid connection with said axial aperture of said base of said second reservoir and wherein said second reservoir has a smaller diameter than said first reservoir;

power conversion means for converting rotational force into reciprocating force wherein the reciprocating output of said power conversion means is mechanically connected to said force receiving surface of said first reservoir.

2. A hydraulicly assisted power transfer device as recited in claim 1, wherein each first one-half rotation of said power conversion means causes said force receiving surface of said first reservoir to move linearly in a first direction, wherein each second one-half rotation of said power conversion means causes said force receiving surface to move in a second direction opposite said first direction, and wherein said force transferring surface of said second reservoir is caused to move a linear distance in said first direction and said second direction, respectively, which is greater than the linear distance said force receiving surface was caused to move by said power conversion means in said first and second directions, respectively.

3. A hydraulicly assisted power transfer device as recited in claim 2, wherein said power conversion means further comprises a central axle, and at least one pair of diametrically opposed arm means attached to said axle.

4. A hydraulically assisted power transfer device as recited in claim 3, wherein said power conversion means further comprises piston means disposed between said arm means and said force receiving surface of said first reservoir, said piston means having a leading end and a trailing end wherein said leading end is disposed adjacent to said force receiving surface and said trailing end is disposed adjacent to said arm means.

5. A hydraulically assisted power transfer device as recited in claim 4, wherein said power conversion means further comprises wheel means for contacting said trailing end of said piston means wherein said wheel means is disposed at the distal tips of each of said arm means.

6. A hydraulicly assisted power transfer device as recited in claim 5, wherein said power conversion means further comprises three diametrically opposed pairs of arm means are attached to said central axle wherein the axis of each pair of arm means is substantially parallel to the axis of the other pairs of arm means and the axis of each pair of arm means is substantially perpendicular to the axis of said central axle.

7. A hydraulicly assisted power transfer device as recited in claim 6, wherein one central pair of arm means is disposed between the two outer pairs of arm means and wherein each central arm means extends further from the axis of said central axle than does any of the outer arm means.

8. A hydraulicly assisted power transfer device as recited in claim 7, further comprising axle means disposed at the end of each arm wherein each of said wheel means are journaled on said axle means, wherein each of said axle means perpendicularly depends from said arm means and wherein each of said axle means is substantially parallel to the axis of said central axle.

9. A hydraulicly assisted power transfer device as recited in claim 4, wherein said piston means has a U-shaped vertical slot which is substantially perpendicularly disposed to said central axle of said power conversion means, wherein the open side of said U-shaped slot faces said central axle and wherein each of said central arm means is configured to mate with said slot.

10. A hydraulicly assisted power transfer device as recited in claim 9, further comprising a downwardly depending plate attached to said piston means, having front and rear faces, wherein said front face of said plate is in the plane of said trailing contact surface of said piston means and wherein said wheel means and each of said central arm means is configured to pass through said U-shaped channel created by said planar surfaces of said slot and said plate and wherein said plate does not completely close the open side of said U-shaped slot.

11. A hydraulicly assisted power transfer device as recited in claim 10, wherein the lower distal end of said plate is bent outwardly toward said central axle of said power conversion means.

12. A hydraulicly assisted power transfer device as recited in claim 1, wherein said force receiving surface is comprised of a tough, resilient, natural or synthetic rubber or latex material and wherein the peripheral edges of said force receiving surface firmly seal around the edge of said side wall of said first reservoir.

13. A hydrauliclly assisted power transfer device as recited in claim 12, wherein an inwardly depending lip and seal is formed in the edge of said side wall and wherein the peripheral edge of said force receiving surface firmly mates with said inwardly depending lip.

14. A hydrauliclly assisted power transfer device as recited in claim 1, further comprising power takeoff means having a power takeoff shaft having a force receiving surface at one end thereof and a distal end at the other end thereof, wherein said force transferring surface of said second reservoir is connected to said power takeoff shaft at said force receiving surface.

15. A hydrauliclly assisted power transfer device as recited in claim 14, wherein said power takeoff shaft is supported by roller bearings encased within a circular track.

16. A hydrauliclly assisted power transfer device as recited in claim 15, further comprising at least one ball bearing attached to said distal end of said power takeoff shaft.

17. A hydrauliclly assisted power transfer device as recited in claim 16, further comprising a plurality of bearings attached to said distal end of said power takeoff shaft.

18. A hydraulically assisted power transfer device as recited in claim 17, further comprising a circular plate and a wheel connected to said plate thereby forming a cylinder, said cylinder being in mechanical engagement with said bearings.

19. A hydraulically assisted power transfer device as recited in claim 18, wherein said circular plate is rotationally supported by an axle.

20. A hydraulically assisted power transfer device as recited in claim 19, further comprising two concentric elliptical tracks, each track having an edge connected to said plate and wherein each said ball bearing disposed at the distal tip of said power takeoff shaft is disposed between said elliptical tracks.

21. A hydraulically assisted power transfer device as recited in claim 20, wherein linear movement of said power takeoff shaft causes each said ball bearing to move in said elliptical tracks, thereby causing said plate and said wheel to rotate about said axle.

22. A hydraulically assisted power transfer device as recited in claim 21, wherein two complete reciprocal cycles of said power takeoff shaft causes said wheel to make one complete revolution.

23. A hydraulically assisted power transfer device as recited in claim 22, wherein rotational power is taken from the surface of said wheel of said power takeoff means.

24. A hydraulically assisted power transfer device comprising:

a first reservoir cylinder having a rigid base and an axial aperture formed in said rigid base, a resilient force receiving surface on the opposite end thereof from said base, and a sidewall connecting said base and said force receiving surface;

a second reservoir, having a base with an axial aperture, a force transferring surface disposed at the opposite end thereof from said base, and a sidewall connecting said base and said force transferring surface wherein said first and second reservoirs together define a closed fluid container, wherein said axial aperture of said base of said first reservoir is in fluid connection with said axial aperture of said base of said second reservoir and wherein said second reservoir has a smaller diameter than said first reservoir;

power conversion means for converting rotational force into reciprocating force wherein the reciprocating output of said power conversion is mechanically connected to said force receiving surface of said first reservoir wherein each first one-half rotation of said power conversion means causes said force receiving surface of said first reservoir to move linearly in a first direction, wherein each second one-half rotation of said power conversion means causes said force receiving surface to move in a second direction opposite said first direction, and wherein said force transferring surface of said second reservoir is caused to move a linear distance in said first direction and said second direction, respectively, which is greater than the linear distance said force receiving surface was caused to move by said power conversion means in said first and second directions, respectively;

piston means disposed between said power conversion means and said force receiving surface of said first reservoir, said piston means having a leading end and a trailing end wherein said leading end is disposed adjacent to said force receiving surface and said trailing end is disposed adjacent to said power conversion means;

at least one pair of diametrically opposed arm means attached to a central axle wherein the axis of each pair of arm means is substantially parallel to the axis of the other arm means and the axis of each pair of arm means is substantially perpendicular to the axis of said central axle; and, wheel means for contacting said trailing end of said piston means, wherein said wheel means are disposed at the distal tips of each of said arm means.

25. A hydraulically assisted power transfer device as recited in claim 24, wherein one central pair of arm means is disposed between two outer pairs of arm means and wherein each central arm means extends further from the axis of said central axle than does any of the outer arm means.

26. A hydraulically assisted power transfer device as recited in claim 25, further comprising axle means disposed at the end of each arm means wherein each of said wheel means is journaled on said axle means, wherein each of said axle means perpendicularly depends from said arm means and wherein each of said axle means is substantially parallel to the axis of said central axle.

27. A hydraulically assisted power transfer device as recited in claim 26, wherein said piston means has a U-shaped vertical slot which is substantially perpendicularly disposed to said central axle of said power conversion means, wherein the open side of said U-shaped slot faces said central axle and wherein each of said central arm means is configured to mate with said slot.

28. A hydraulically assisted power transfer device as recited in claim 27, further comprising a downwardly depending plate attached to said piston means, having front and rear faces, wherein said front face of said plate is in the plane of said trailing contact surface of said piston means, and wherein said wheel means and each of said central arm means is configured to pass through said U-shaped channel created by said planar surfaces of said slot and said plate and wherein said plate does not completely close the open side of said U-shaped slot.

29. A hydraulically assisted power transfer device as recited in claim 28, wherein the lower distal end of said plate is bent outwardly toward said central axle of said power conversion means.

* * * * *